US010777910B2

(12) United States Patent
Wu

(10) Patent No.: US 10,777,910 B2
(45) Date of Patent: Sep. 15, 2020

(54) HIGH-ISOLATION DUAL-BAND ANTENNA

(71) Applicant: ARCADYAN TECHNOLOGY CORPORATION, Hsinchu (TW)

(72) Inventor: Min-Chi Wu, Zhubei (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 8 days.

(21) Appl. No.: 16/396,922

(22) Filed: Apr. 29, 2019

(65) Prior Publication Data

US 2019/0334254 A1 Oct. 31, 2019

(30) Foreign Application Priority Data

Apr. 30, 2018 (TW) ..... 107114678 A

(51) Int. Cl.

| | |
|---|---|
| ***H01Q 21/28*** | (2006.01) |
| ***H01Q 1/48*** | (2006.01) |
| ***H01Q 5/50*** | (2015.01) |
| ***H01Q 5/307*** | (2015.01) |

(52) U.S. Cl.

CPC ..... *H01Q 21/28* (2013.01); *H01Q 1/48* (2013.01); *H01Q 5/307* (2015.01); *H01Q 5/50* (2015.01)

(58) Field of Classification Search

CPC ..... H01Q 21/28; H01Q 25/00; H01Q 5/40; H01Q 5/50; H01Q 5/35; H01Q 5/321; H01Q 5/328; H01Q 5/307; H01Q 5/371; H01Q 9/0435; H01Q 9/42; H01Q 1/38; H01Q 1/48; H01Q 1/243; H01Q 1/521

See application file for complete search history.

(56) References Cited

U.S. PATENT DOCUMENTS

| | | | | |
|---|---|---|---|---|
| 6,172,651 | B1 * | 1/2001 | Du | H01Q 1/125 333/109 |
| 8,354,972 | B2 * | 1/2013 | Borja | H01Q 1/38 343/700 MS |
| 8,937,578 | B2 * | 1/2015 | Montgomery | H01Q 1/243 343/841 |
| 9,484,631 | B1 * | 11/2016 | Napoles | H01Q 1/243 |
| 10,148,011 | B2 * | 12/2018 | Wu | H01Q 5/35 |
| 2007/0001911 | A1 | 1/2007 | Fujio et al. | |
| 2010/0238079 | A1 | 9/2010 | Ayatollahi et al. | |
| 2012/0274522 | A1 | 11/2012 | Ayatollahi | |
| 2016/0093949 | A1 | 3/2016 | Chang et al. | |

* cited by examiner

*Primary Examiner* — Haissa Philogene

(74) *Attorney, Agent, or Firm* — Locke Lord LLP; Tim Tingkang Xia, Esq.

(57) ABSTRACT

A high-isolation dual-band antenna is provided, which may be operated in a first frequency band and a second frequency band, and include a ground zone, two radiators and an isolation zone. The radiators may be disposed at the both sides of the ground zone respectively. The isolation zone may include a main body, a first-slot and two second-slots; the first-slot may be disposed at one end of the main body and the second-slots may be disposed at the both sides of the main body respectively. At least a portion of the first-slot and the second-slots may serve as the isolation section of the first frequency band, and at least a portion of each second-slot may serve as the isolation section of the second frequency band, such that the isolation section of the first frequency band may partially overlap the isolation section of the second frequency band.

11 Claims, 7 Drawing Sheets

HIGH-ISOLATION DUAL-BAND ANTENNA

CROSS REFERENCE TO RELATED APPLICATION

This application also claims priority to Taiwan Patent Application No. 107114678 filed in the Taiwan Patent Office on Apr. 30, 2018, the entire content of which is incorporated herein by reference.

TECHNICAL FIELD

The present disclosure relates to an antenna, in particular to a high-isolation dual-band antenna and applicable to wireless transmission devices.

BACKGROUND

As the advance of technology, portable electronic devices (e.g. mobile phones, tablet computers and notebook computers, etc.) and wireless transmission devices (e.g. USB connection devices, wireless network cards and access points) are becoming more and more powerful, so these devices' requirements for antennas are also becoming stricter.

Currently, planar inverse-F antennas (PIFA) of compact size and with great transmission performance have been comprehensively applied to portable electronic devices and wireless transmission devices. Antennas may need several operating frequency bands in order to satisfy the requirements of different frequency bands. However, the antenna characteristics of the currently available dual-band antennas cannot be easily adjusted because of the limitations in their structure designs; for the reason, antenna designers always need to spend a lot of time on adjusting the structures of these antennas in order to realize desired antenna characteristics.

In addition, the isolation is another important factor capable of influencing the performance of antennas. However, the isolations of the currently available dual-band antennas usually cannot meet the requirements because of the limitations in their structure designs, so the performances of these antennas are influenced accordingly.

Therefore, it has become an important issue to provide a dual-band antenna capable of improving the limitations of the currently available antennas.

SUMMARY

The present disclosure is related to a dual-band antenna. In one embodiment of the disclosure, the dual-band antenna may include a substrate, a grounding-layer, two radiating-layers and two feed points. The substrate has a surface. The grounding-layer is formed on the surface of the substrate and includes two accommodating cavities, an isolation cavity, a first-slot and two second-slots. The accommodating cavities are disposed at the two top corners of the grounding-layer; each is respectively surrounded by a first-extension at the side of the grounding-layer and a second-extension at the top side of the grounding-layer. The isolation cavity is disposed between the accommodating cavities and includes a main-block. The first-slot is disposed at the bottom end of the main-block, extends from the main-block toward the bottom side of the grounding-layer and then extends toward the accommodating cavities respectively to form two branches. The second-slots are disposed at the both sides of the main-block respectively, extend from the main-block toward the accommodating cavities respectively and then extend toward the top side of the grounding-layer. Each of the radiating-layers is disposed inside each of the accommodating cavities. The feed points are located oppositely on the first-extension side of the radiating-layers, and connect the radiating-layers to the grounding-layer respectively.

The present disclosure is further related to a high-isolation antenna. In one embodiment of the disclosure, the high-isolation dual-band antenna may be operated in a first frequency band and a second frequency band, and include a ground zone, two radiators and an isolation zone. The radiators may be disposed at the both sides of the ground zone respectively. The isolation zone may include a main body, a first-slot and two second-slots; the first-slot may be disposed at one end of the main body and the second-slots may be disposed at both sides of the main body respectively. At least a portion of the first-slot and the second-slots may serve as the isolation section of the first frequency band, and at least a portion of each second-slot may serve as the isolation section of the second frequency band, such that the isolation section of the first frequency band may partially overlap the isolation section of the second frequency band.

In a preferred embodiment, the frequency of the second frequency band may be higher than the frequency of the first frequency band.

In a preferred embodiment, the high-isolation dual-band antenna may further include two feed points connecting the radiators to the ground zone respectively; one side of each of the feed point may generate a first current and the first current may flow along a path extending from one side of the feed point to the ground zone to generate a first exciting current in the ground zone; the resonance between the first current and the first exciting current may generate the signals of the first frequency band.

In a preferred embodiment, the other side of each of the feed point may generate a second current and the second current may flow along a path extending from the other side of the feed point to the ground zone to generate a second exciting current in the ground zone; the resonance between the second current and the second exciting current generates the signals of the second frequency band.

In a preferred embodiment, each of the both sides of the ground zone may include a first extension and a second extension, and an accommodating zone may be formed between the first extension, the second extension and the grounding zone; the radiators may be disposed inside the accommodating zones respectively.

In a preferred embodiment, the length of the first extension may be related to at least the central frequency point of the first frequency band, and the width of the first extension may be related to at least the matching characteristic of the first frequency band.

In a preferred embodiment, the length of the second extension may be related to at least the central frequency point of the second frequency band, and the width of the second extension may be related to at least the matching characteristic of the second frequency band.

In a preferred embodiment, the length of the isolation section of the first frequency band may be related to at least one of the central frequency point of the isolation of the first frequency band and the isolation of the first frequency band.

In a preferred embodiment, the length of the isolation section of the second frequency band may be related to at least one of the central frequency point of the isolation of the second frequency band and the isolation of the second frequency band.

In a preferred embodiment, the first-slot may extend from the main body and toward the bottom of the ground zone first, and then extend toward the radiators respectively; the second-slots may extend from the main body and toward the radiators respectively first and then extend toward the top of the main body.

As described above, the high-isolation dual-band antenna according to the embodiments of the present disclosure may have one or more than one of the following advantages:

(1) In one embodiment of the present disclosure, the dual-band antenna has a special structure design, so antenna designers do not need to spend a lot of time on adjusting the structure of the antenna according to different requirements but can directly realize the desired antenna characteristics just by adjusting the size of each part of the antenna; therefore, the antenna designers can more efficiently design the antennas so as to conform to their requirements.

(2) In one embodiment of the present disclosure, the dual-band antenna has a special structure design, so antenna designers can directly realize the desired antenna characteristics meeting different requirements just by adjusting the size of each part of the antenna; therefore, the application of the dual-band antenna can be more comprehensive.

(3) In one embodiment of the present disclosure, the isolation zone of the dual-band antenna has a special structure design, so the isolation zone can achieve higher isolation; therefore, the performance of the dual-band antenna can be optimized to significantly better the performance of the dual-band antenna.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
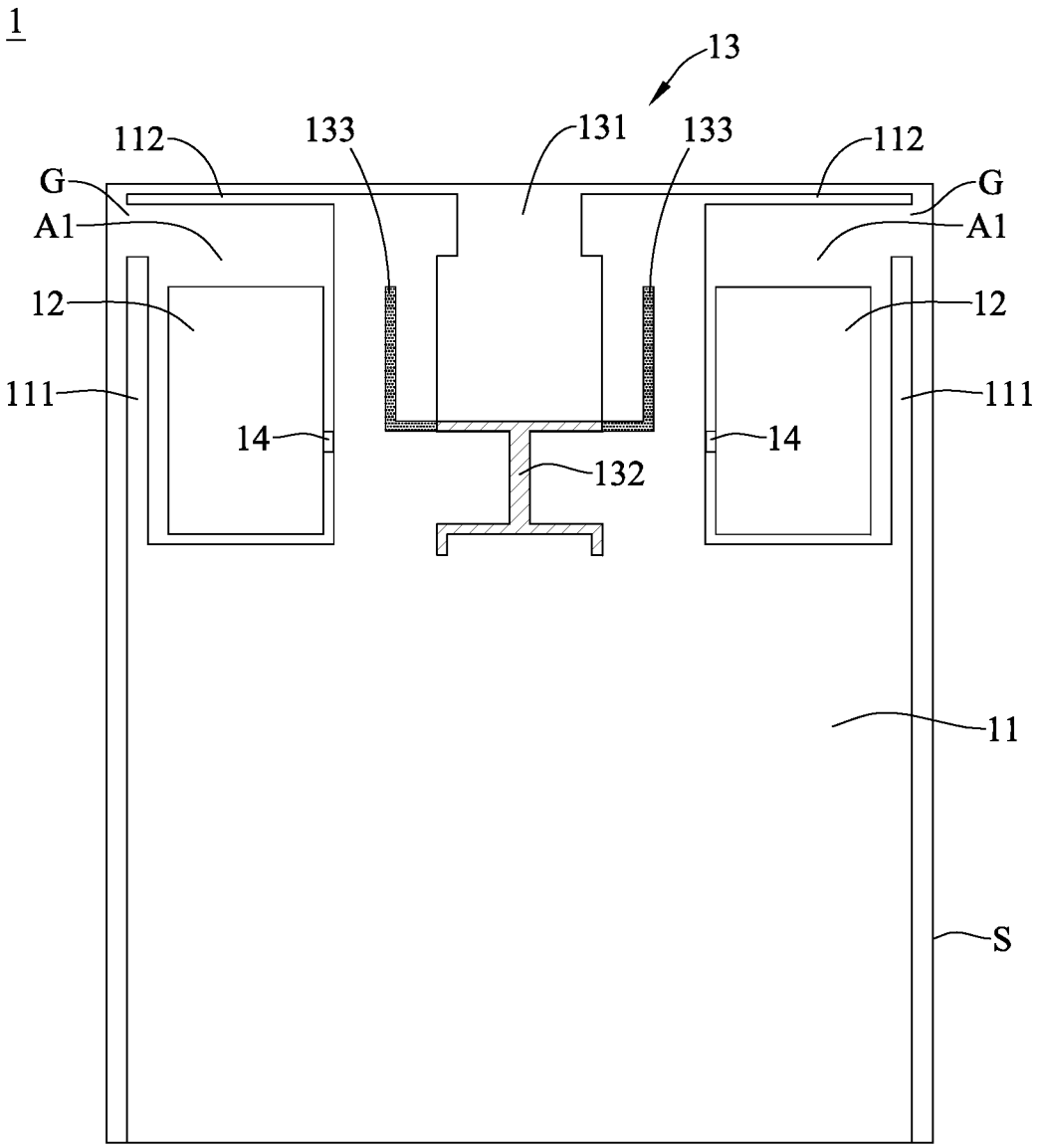
FIG. 1 is a structure diagram of a high-isolation dual-band antenna in accordance with a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Figure 2:
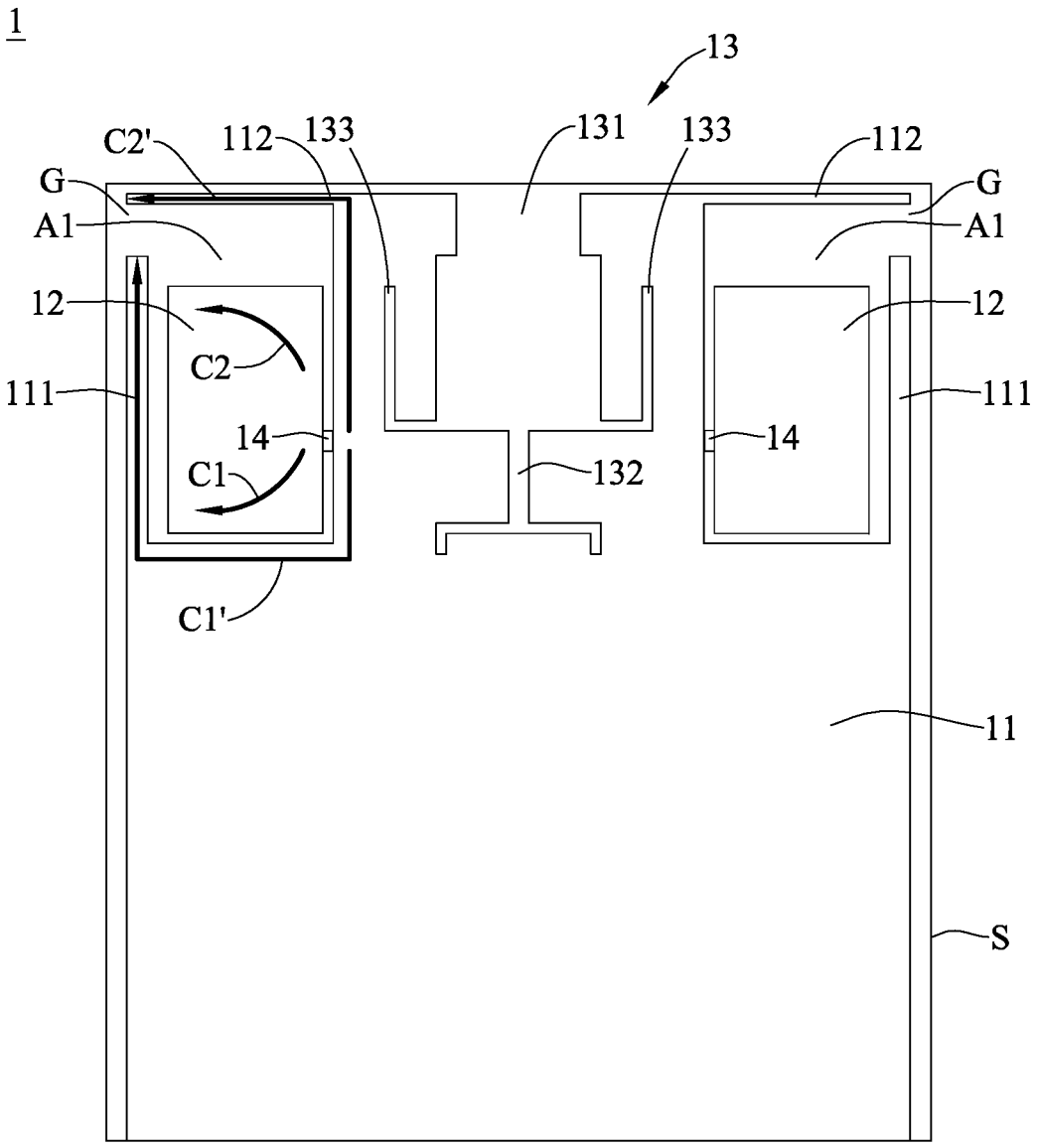
FIG. 2 is a first schematic view of the high-isolation dual-band antenna in accordance with the first embodiment of the present disclosure.
Figure 3:
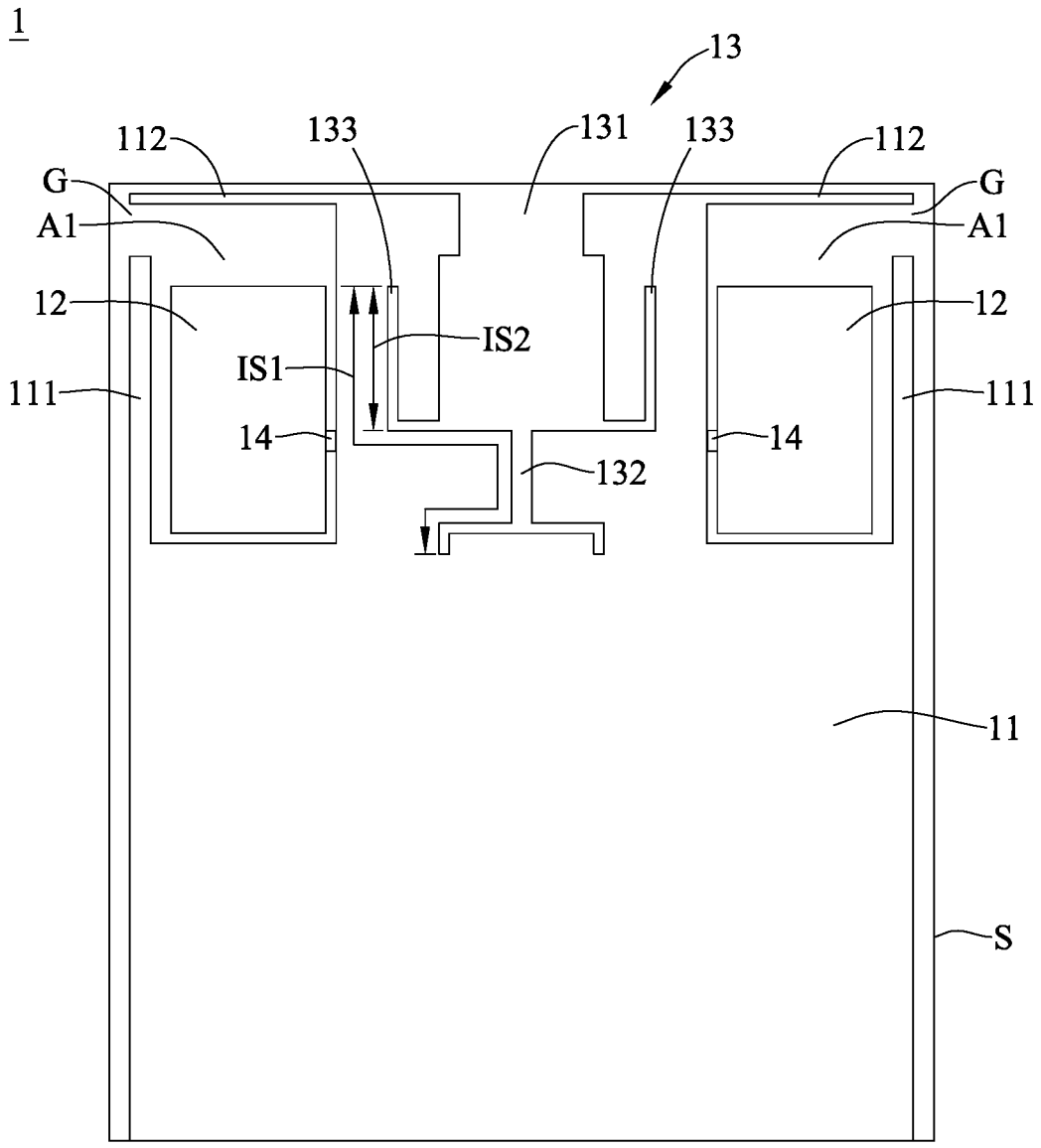
FIG. 3 is a third schematic view of the high-isolation dual-band antenna in accordance with the first embodiment of the present disclosure.

Please refer to FIG. 1~FIG. 3, which are a structure diagram, a first schematic view and a second schematic view in accordance with a first embodiment of the present disclosure. As shown in FIG. 1, the dual-band antenna 1 includes a substrate S, a conductive grounding-layer 11, two conductive radiating-layer 12 and two feed points 14. The substrate S includes a substrate S having a surface. The grounding-layer 11 is formed on the surface of the substrate S, and includes two accommodating cavities A1, an isolating cavity 13, a first-slot 132 and two second-slots 133. The accommodating cavities A are disposed at the two top corners of the grounding-layer 11; each respectively surrounded by a first-extension 111 at the side of the grounding-layer 11 and a second-extension 112 at the top side of the grounding-layer 11; there is a gap G between the ends of the first-extension 111 and the second-extension 112. The isolation cavity 13 are formed by removing the material on the grounding-layer 11 and disposed between the accommodating cavities A1; the isolation cavity 13 includes a main-block 131. The first-slot 132 is disposed at the bottom end of the main-block 131, extends from the main-block 131 toward the bottom side of the grounding-layer 11 and then extends toward the accommodating cavities A1 respectively to form two branches. The second-slots 133 are disposed at the both sides of the main-block 131 respectively, extend from the main-block 131 toward the accommodating cavities A1 respectively and then extend toward the top side of the grounding-layer 11. Each of the radiating-layers 12 is disposed inside each of the accommodating cavities A1. The feed points 14 is located oppositely on the first-extension 111 side of the radiating-layers 12, and connects the radiating-layers 12 to the grounding-layer 11 respectively.

As shown in FIG. 2, when the signals are fed into the feed point 14, a first current C1 generates at one side of the feed point 14; the first current C1 flows along the path extending from one side of the feed point 14 to the grounding-layer 11 to generate a first exciting current C1' in the grounding-layer 11; the resonance between the first current C1 and the first exciting current C1' generates the signals of a first frequency band.

When the signals are fed into the feed point 14, a second current C2 also generates at the other side of the feed point 14; the second current C2 flows along the path extending from the other side of the feed point 14 to the grounding-layer 11 to generate a second exciting current C2' in the grounding-layer 11; the resonance between the second current C2 and the second exciting current C2' generates the signals of a second frequency band.

As describe above, the two frequency bands of the antenna 1 in the embodiment can be realized by the coupling between the monopole antennas and the grounding-layer 11.

As shown in FIG. 3, at least a portion of each second-slot 133 can serve as an isolation section IS2 of the second frequency band; besides, the length of the isolation section IS2 of the second frequency band may be ¼ wavelength of the second frequency band or proportional to ¼ wavelength of the second frequency band. In the embodiment, the second frequency band may be 5G, so the length of the isolation section IS2 of the second frequency band may be ¼ wavelength of 5G or proportional to ¼ wavelength of 5G.

Adjust the sizes of the second-slots 133 and change the length of the isolation section IS2 of the second frequency band can adjust the antenna characteristics of the dual-band antenna 1 in order to satisfy different requirements. The length of the isolation section IS2 is related to at least one of the central frequency point of the isolation of the second frequency band.

At least a portion of the first-slot 132 and the second-slots 133 can serve as an isolation section IS1 of the first frequency band; besides, the length of the isolation section IS1 of the first frequency band may be ¼ wavelength of the first frequency band or proportional to ¼ wavelength of the first frequency band. In the embodiment, the first frequency band may be 2.4G, so the length of the isolation section IS1 of the first frequency band may be ¼ wavelength of 2.4G or proportional to ¼ wavelength of 2.4G.

Adjust the size of the first-slot 132 or the second-slots 133 and change the length of the isolation section IS1 of the first frequency band can adjust the antenna characteristics of the dual-band antenna 1 in order to satisfy different requirements. The length of the isolation section IS1 of the first frequency band is related to at least one of the central frequency point of the isolation of the first frequency band.

Please refer to FIG. 1~FIG. 3, which are a structure diagram, a first schematic view and a second schematic view in accordance with the other embodiment of the present disclosure. As shown in FIG. 1, the dual-band antenna 1 has two operating frequency bands, the first frequency band and the second frequency band, and includes a ground zone 11, two radiators 12, an isolation zone 13 and two feed points 14. In the embodiment, the frequency of the second frequency band is higher than the frequency of the first frequency band; for example, the first frequency band may be 2.4G and the second frequency band may be 5G.

One side of the ground zone 11 includes a first extension 111 and a second extension 112. The ground zone 11 has a missing corner at one side thereof; the first extension 11 extends toward the top of the ground zone 11 and the second extension 112 extends toward the left side of the ground zone 11, such that the space between first extension 111, the second extension 112 and the ground zone 11 can form an accommodating zone A1 not completely sealed.

Similarly, the other side of the ground zone 11 also includes a first extension 111 and a second extension 112. The ground zone 11 also has a missing corner at the other side thereof; the first extension 11 extends toward the top of the ground zone 11 and the second extension 112 extends toward the right side of the ground zone 11, such that the space between first extension 111, the second extension 112 and the ground zone 11 can form an accommodating zone A1 not completely sealed.

The radiators 12 are disposed in the accommodating zones A1 of the both sides of the ground zone 11; these radiators 12 may be monopole antennas. Besides, the first extensions 111 and the second extensions 112 of the ground zone 11 can couple to the radiators 12 to generate signals, so can be considered part of the radiators 12.

The isolation zone 13 is disposed between the radiators 12. More specifically, the isolation zone 13 is formed by removing the material on the ground zone 11. The isolation zone 13 is a part of the dielectric zone; the isolation zone 13 includes a main body 131, a first-slot 132 and two second-slots 133; the first-slot 132 and the second-slots 133 can provide the isolation effect. The first-slot 132 extends from the main body 131 toward the bottom of the ground zone 11 and then extends toward the radiators 12 respectively.

The second-slots 133 are disposed at the both sides of the main body 131 respectively; more specifically, one of the second-slots 133 extends from the main body 131 toward the radiator 12 at the left side and then extends toward the top of the main body 131; the other one of the second-slots 133 extends from the main body 131 toward the radiator 12 at the right side and then extends toward the top of the main body 131.

The feed points 14 connect the radiators 12 to the ground zone 11 respectively.

The antenna characteristics of the dual-band antenna 1 can be adjusted by changing the sizes of the parts of the dual-band antenna 1 respectively. For example, adjusting the sizes of the radiators 12, the first extensions 111 and the second extension 112 can change the central frequency point of the first frequency band, the central frequency point of the second frequency band, the matching characteristic of the first frequency band and the matching characteristic of the second frequency band respectively. In addition, adjusting the sizes of the first-slot 132 and the second-slots 133 can change the central frequency point of the isolation of the first frequency band and the central frequency point of the isolation of the second frequency band respectively.

As shown in FIG. 2, when the signals are fed into the feed point 14, a first current C1 generates at one side of the feed point 14; the first current C1 flows along the path extending from one side of the feed point 14 to the ground zone 11 to generate a first exciting current C1' in the ground zone 11; the resonance between the first current C1 and the first exciting current C1' generates the signals of the first frequency band.

When the signals are fed into the feed point 14, a second current C2 generates at the other side of the feed point 14; the second current C2 flows along the path extending from the other side of the feed point 14 to the ground zone 11 to generate a second exciting current C2' in the ground zone 11; the resonance between the second current C2 and the second exciting current C2' generates the signals of the second frequency band.

As describe above, the two frequency bands of the antenna 1 in the embodiment can be realized by the coupling between the monopole antennas and the ground zone 11.

As shown in FIG. 3, at least a portion of each second-slot 133 can serve as the isolation section IS2 of the second frequency band; besides, the length of the isolation section IS2 of the second frequency band may be ¼ wavelength of the second frequency band or proportional to ¼ wavelength of the second frequency band. In the embodiment, the second frequency band may be 5G, so the length of the isolation section IS2 of the second frequency band may be ¼ wavelength of 5G or proportional to ¼ wavelength of 5G.

Adjusting the sizes of the second-slots 133 can change the length of the isolation section IS2 of the second frequency band to adjust the antenna characteristics of the dual-band antenna 1 in order to satisfy different requirements. The length of the isolation section IS2 of the second frequency band is related to at least one of the central frequency point of the isolation of the second frequency band and the isolation of the second frequency band. Adjusting the length of the isolation section IS2 of the second frequency band can change one or more than one of the central frequency point of the isolation of the second frequency band and the isolation of the second frequency band.

At least a portion of the first-slot 132 and the second-slots 133 can serve as the isolation section IS1 of the first frequency band; besides, the length of the isolation section IS1 of the first frequency band may be ¼ wavelength of the first frequency band or proportional to ¼ wavelength of the first frequency band. In the embodiment, the first frequency band may be 2.4G, so the length of the isolation section IS1 of the first frequency band may be ¼ wavelength of 2.4G or proportional to ¼ wavelength of 2.4G.

Adjusting the size of the first-slot 132 or the second-slots 133 can change the length of the isolation section IS1 of the first frequency band to adjust the antenna characteristics of the dual-band antenna 1 in order to satisfy different requirements. The length of the isolation section IS1 of the first frequency band is related to at least one of the central frequency point of the isolation of the first frequency band and the isolation of the first frequency band. Adjusting the length of the isolation section IS1 of the first frequency band can change one or more than one of the central frequency point of the isolation of the first frequency band and the isolation of the first frequency band.

Therefore, as described above, the isolation section IS1 of the first frequency band of the high-isolation dual-band antenna 1 according to the present disclosure may partially overlap the isolation section IS2 of the second frequency band thereof.

In addition, please note that the extension directions and the lengths of the first-slot 132 and the second-slot 133 can be adjusted according to actual conditions in order to conform to satisfy the requirements of different frequency bands. For instance, the first-slot 132, in the embodiment, extends from the main body 131 toward the bottom of the ground zone 11 and then extends toward the radiators 12 respectively to form two branches; then, each branch further extends toward the bottom of the ground zone 11. In another embodiment, the antenna designer can bend the branches or form the branches in different shapes, instead of extending the branches to the bottom of the ground zone 11, according to the requirements of the design.

As described above, the isolation zone 13 of the dual-band antenna 1 has a special structure design; in other words, the isolation of the dual-band antenna 1 can be effectively increased because the isolation section IS1 of the first frequency band partially overlaps the isolation section IS2 of the second frequency band; thus, the performance of the dual-band antenna 1 can be significant improved.

Via the above special structure design, the dual-band antenna 1 of the embodiment can achieve excellent isolation, so the performance of the dual-band antenna 1 can be optimized. In addition, the antenna characteristics of the dual-band antenna 1 can be directly adjusted just by changing the parts of the dual-band antenna 1 respectively in order to conform to different requirements.

The embodiment just exemplifies the present disclosure and is not intended to limit the scope of the present disclosure; any equivalent modification and variation according to the spirit of the present disclosure is to be also included within the scope of the following claims and their equivalents.

It is worthy to point out that the antenna characteristics of the currently available dual-band antennas cannot be easily adjusted because of the limitations in their structure designs; for the reason, antenna designers always need to spend a lot of time on adjusting the structures of these antennas in order to realize desired antenna characteristics. On the contrary, according to one embodiment of the present disclosure, the dual-band antenna has a special structure design, so antenna designers do not need to spend a lot of time on adjusting the structure of the antenna according to different requirements but can directly realize the desired antenna characteristics just by adjusting the size of each part of the antenna; therefore, antenna designers can more efficiently design the antennas able to conform to their requirements.

Besides, according to one embodiment of the present disclosure, the dual-band antenna has a special structure design, so antenna designers can directly realize the desired antenna characteristics meeting different requirements just by adjusting the size of each part of the antenna; therefore, the application of the dual-band antenna can be more comprehensive.

Moreover, according to one embodiment of the present disclosure, the isolation zone of the dual-band antenna has a special structure design, so the isolation zone can achieve higher isolation; therefore, the performance of the dual-band antenna can be optimized to significantly better the performance of the dual-band antenna.

Figure 4:
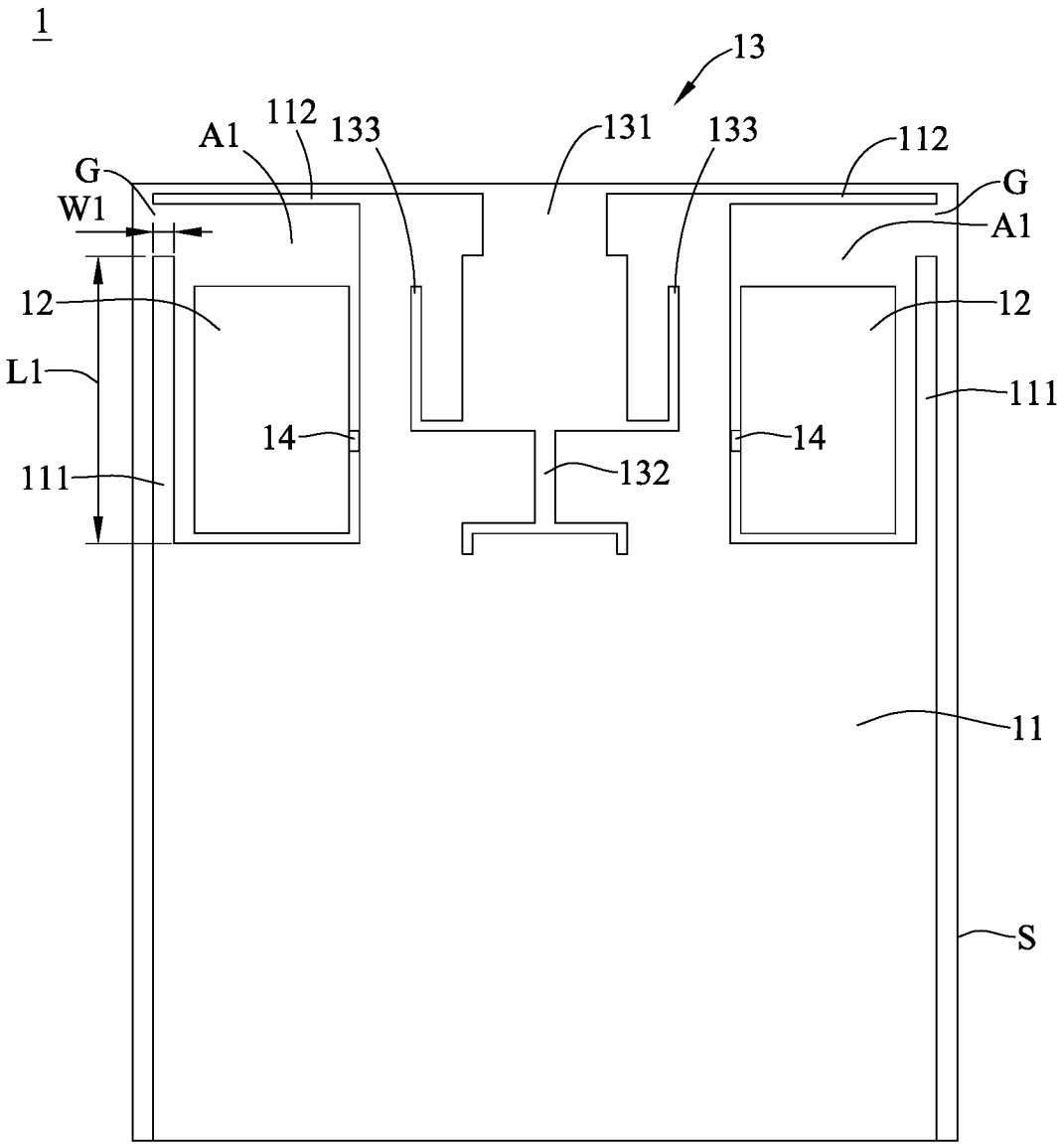
FIG. 4 is a schematic view of the high-isolation dual-band antenna in accordance with a second embodiment of the present disclosure.

Please refer to FIG. 4, which is a schematic view of the high-isolation dual-band antenna in accordance with a second embodiment of the present disclosure. As shown in FIG. 4, the size of the first extensions 111 of the dual-band antenna 1 can be adjusted to change the antenna characteristics of the dual-band antenna 1 so as to conform to different requirements. The length L1 of the first extensions 111 is related to at least the central frequency point of the first frequency band. Increasing the length L1 of the first extensions 111 can adjust the central frequency point of the first frequency band in the direction of low frequency; on the contrary, decreasing the length L1 of the first extensions 111 can adjust the central frequency point of the first frequency band in the direction of high frequency. Besides, adjusting the length L1 of the first extensions 111 can also slightly adjust the central frequency point of the isolation of the second frequency band and the matching characteristic of the second frequency band.

The width W1 of the first extensions 111 is related to at least the matching characteristic of the first frequency band. The width W1 of the first extensions 111 should be proper; if the width W1 of the first extensions 111 is too wide or too narrow, the matching characteristic of the first frequency band deteriorates. Besides, adjusting the width W1 of the first extensions 111 can also slightly adjust the central frequency point of the first frequency band, the central frequency point of the isolation of the first frequency band, the matching characteristic of the second frequency band, the central frequency point of the second frequency band and the central frequency point of the isolation of the second frequency band.

Figure 5:
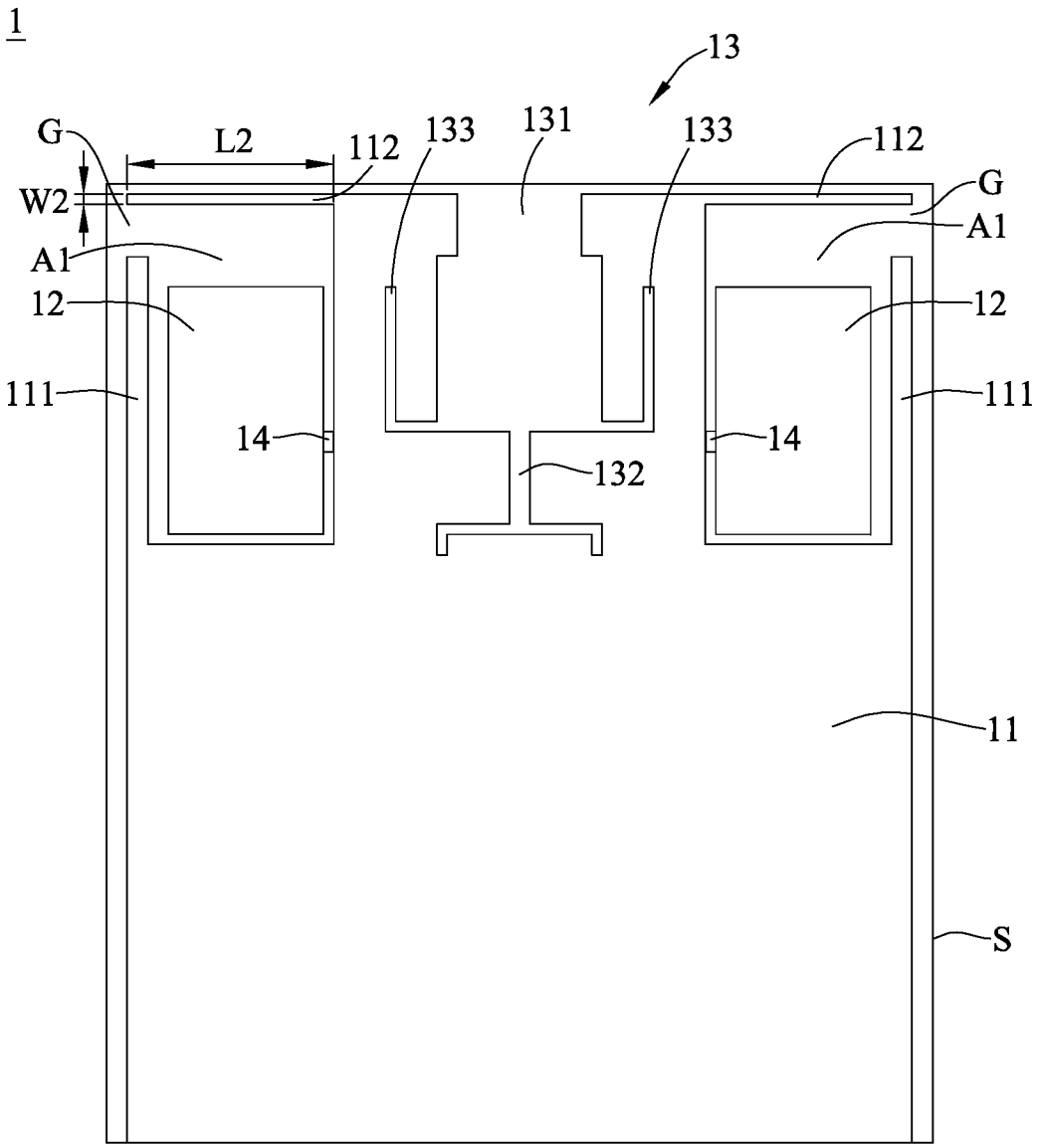
FIG. 5 is a schematic view of the high-isolation dual-band antenna in accordance with a third embodiment of the present disclosure.

Please refer to FIG. 5, which is a schematic view of the high-isolation dual-band antenna in accordance with a third embodiment of the present disclosure. As shown in FIG. 5, the size of the second extensions 112 of the dual-band antenna 1 can be adjusted to change the antenna characteristics of the dual-band antenna 1 so as to conform to different requirements. The length L2 of the second extensions 112 is related to at least the central frequency point of the second frequency band. Increasing the length L2 of the second extensions 112 can adjust the central frequency point of the second frequency band in the direction of low frequency; on the contrary, decreasing the length L2 of the second extensions 112 can adjust the central frequency point of the second frequency band in the direction of high frequency. Besides, adjusting the length L2 of the second extensions 112 can also slightly adjust the central frequency point of the first frequency band, the isolation of the first frequency band, the matching characteristic of the first frequency band, the isolation of the second frequency band and the matching characteristic of the second frequency band. Moreover, the length L2 of the second extensions 112 is also related to the resonance between the second extension 112 and the radiators 12; the length L2 should be higher than a certain value, or the resonance between the second extensions 112 and the radiators will not occur.

The width W2 of the second extensions 112 is related to at least the matching characteristic of the second frequency band. The width W2 of the second extensions 112 should be proper; if the width W2 of the second extensions 112 is too wide, the matching bandwidth becomes narrower. Besides, adjusting the width W2 of the second extensions 112 can also slightly adjust the central frequency point of the first frequency band, the isolation of the first frequency band, the matching characteristic of the first frequency band and the isolation of the second frequency band.

Figure 6:
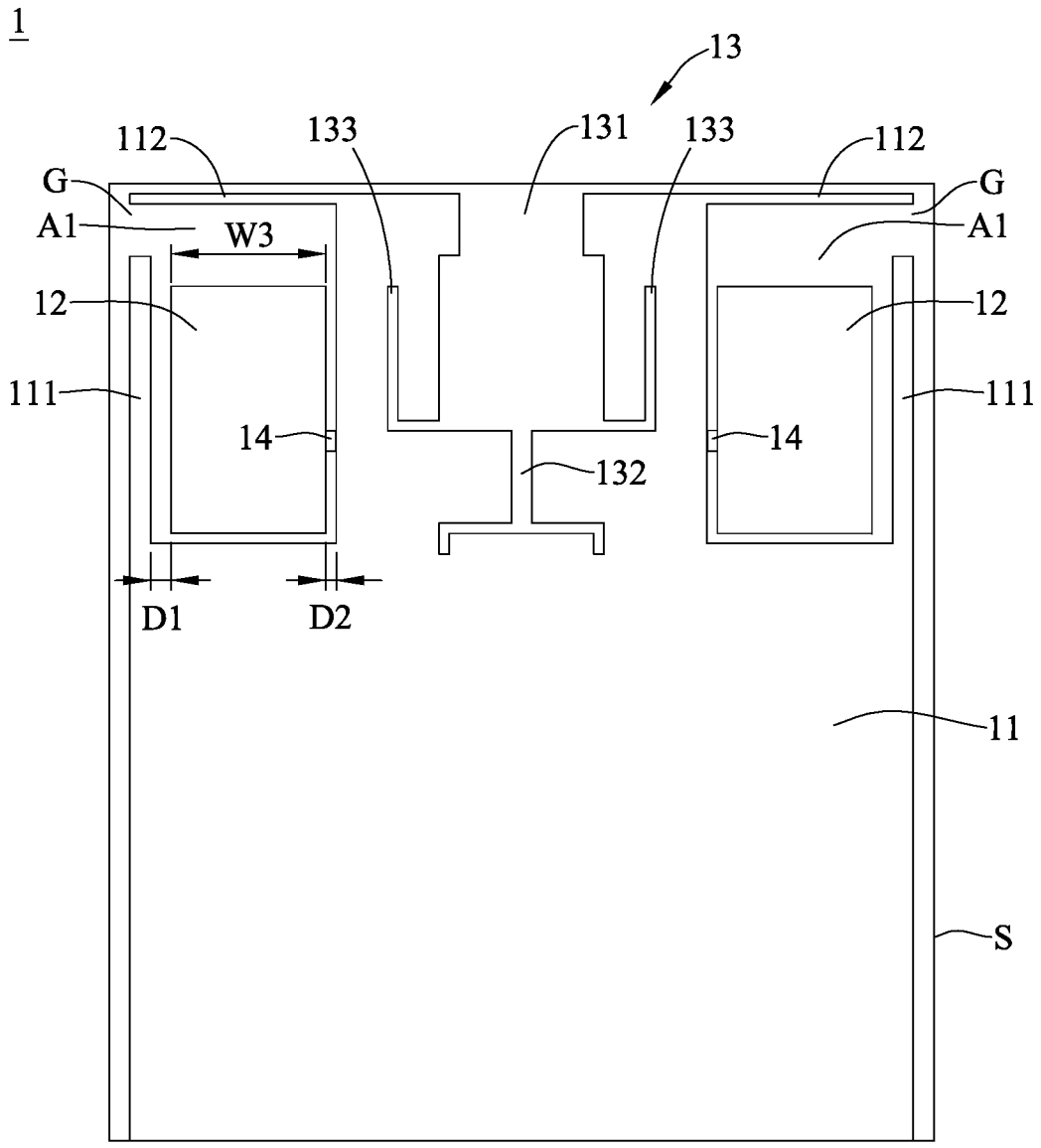
FIG. 6 is a schematic view of the high-isolation dual-band antenna in accordance with a fourth embodiment of the present disclosure.

Please refer to FIG. 6, which is a schematic view of the high-isolation dual-band antenna in accordance with a fourth embodiment of the present disclosure. As shown in FIG. 6, the size of the radiators 12 of the dual-band antenna 1 can be adjusted to change the antenna characteristics of the dual-band antenna 1 so as to conform to different requirements. The width W3 of the radiators 12 is related to at least the matching characteristic of the first frequency band and the matching characteristic of the second frequency band. Adjusting the width W3 of the radiators 12 can change the distance D1 between the radiators 12 and the first extensions 111 to change the matching characteristic of the first frequency band. Adjusting the width W3 of the radiators 12 can change the distance D2 between the radiators 12 and the ground zone 11 on the feed points 14 side to adjust the matching characteristic of the second frequency band. Besides, adjusting the width W3 of the radiators 12 can also slightly adjust the central frequency point of the first frequency band, the central frequency point of the isolation of the first frequency band, the central frequency point of the second frequency band and the central frequency point of the isolation of the second frequency band.

Figure 7:
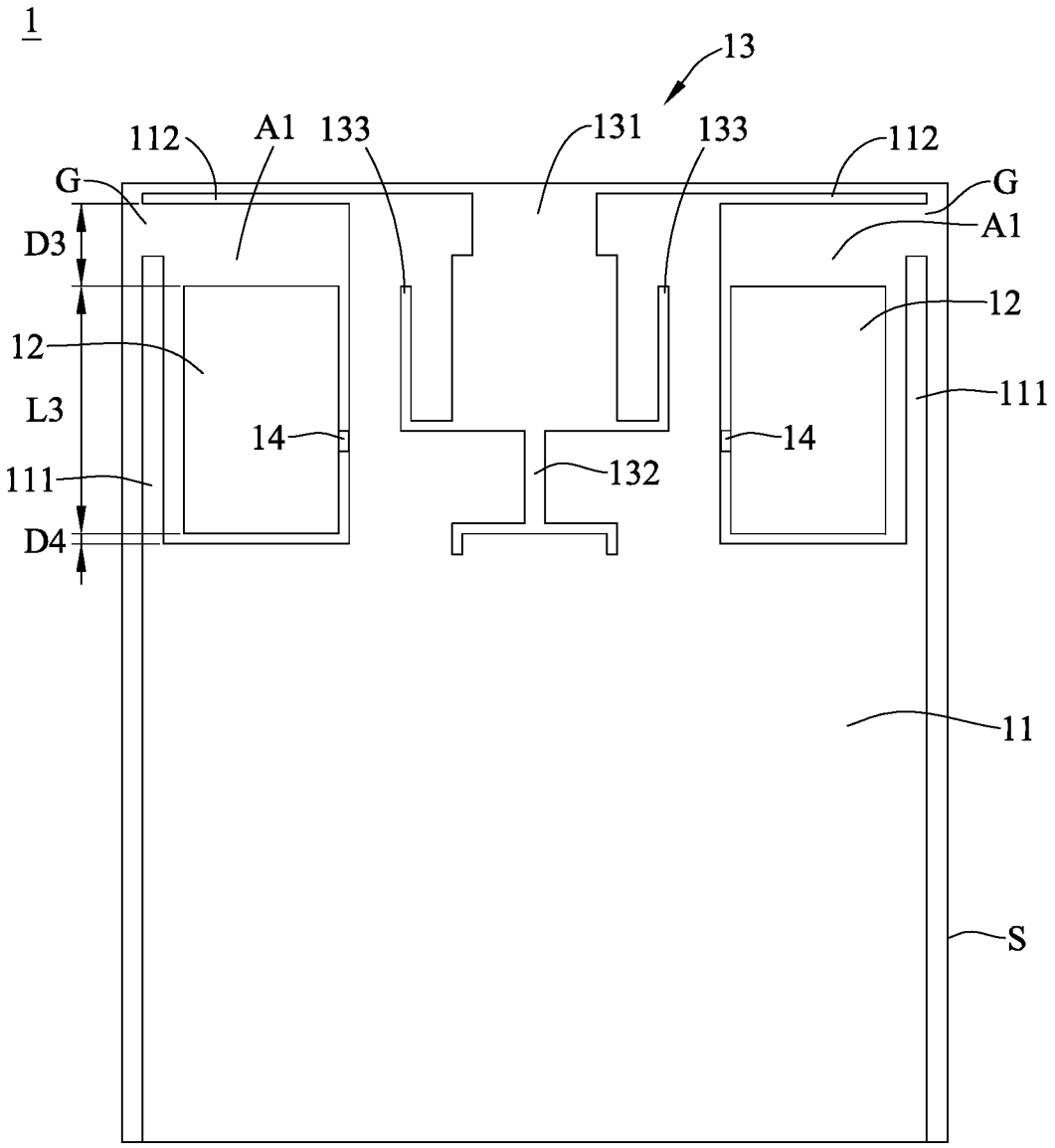
FIG. 7 is a schematic view of the high-isolation dual-band antenna in accordance with a fifth embodiment of the present disclosure.

Please refer to FIG. 7, which is a schematic view of the high-isolation dual-band antenna in accordance with a fifth embodiment of the present disclosure. As shown in FIG. 7, the size of the radiators 12 of the dual-band antenna 1 can be adjusted to change the antenna characteristics of the dual-band antenna 1 so as to conform to different requirements. The length L3 of the radiators 12 is related to at least the matching characteristic of the first frequency band and the matching characteristic of the second frequency band. Adjusting the length L3 of the radiators 12 can change the distance D3 between the tops of the radiators 12 and the second extensions 112 to change the matching characteristic of the first frequency band. Adjusting the length L3 of the radiators 12 can change the distance D4 between the bottoms of the radiators 12 and the ground zone 11 to adjust the matching characteristic of the second frequency band. Besides, adjusting the length L3 of the radiators 12 can also slightly adjust the bandwidth of the second frequency band and the isolation of the second frequency band.

As described above, as the dual-band antenna 1 has a special structure design, the antenna characteristics of the dual-band antenna 1 can be directly adjusted just by changing the size of each part thereof; thus, the dual-band antenna 1 can achieve all desired antenna characteristics, so is applicable to different frequency bands, such as 802.11a (5150~5850 MHz), 802.11b (2400~2500 MHz), 802.11g (2400~2500 MHz) and 802.11n (2.4 GHz or 5 GHz Band). Accordingly, antenna designers can easily satisfy different requirements just by slightly adjusting the structure of the dual-band antenna 1 instead of re-designing the whole structure of the dual-band antenna 1 according to different requirements. Therefore, the application of the dual-band antenna 1 according to the embodiments of the present disclosure can be more comprehensive.

To sum up, according to one embodiment of the present disclosure, the dual-band antenna has a special structure design, so antenna designers do not need to spend a lot of time on adjusting the structure of the antenna according to different requirements but can directly realize the desired antenna characteristics just by adjusting the size of each part of the antenna; therefore, antenna designers can more efficiently design the antennas able to conform to their requirements.

Besides, according to one embodiment of the present disclosure, the dual-band antenna has a special structure design, so antenna designers can directly realize the desired antenna characteristics meeting different requirements just by adjusting the size of each part of the antenna; therefore, the application of the dual-band antenna can be more comprehensive.

Moreover, according to one embodiment of the present disclosure, the isolation zone of the dual-band antenna has a special structure design, so the isolation zone can achieve higher isolation; therefore, the performance of the dual-band antenna can be optimized to significantly better the performance of the dual-band antenna.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A dual-band antenna, comprising:

a substrate having a surface;

a grounding-layer, formed on the surface of the substrate, comprising two accommodating cavities, disposed at two top corners of the grounding-layer, each respectively surrounded by a first-extension at a side of the grounding-layer and a second-extension at a top side of the grounding-layer;

an isolation cavity, disposed between the accommodating cavities, including a main-block;

a first-slot, disposed at a bottom end of the main-block, extending from the main-block toward the bottom side of the grounding-layer and then extending toward the accommodating cavities respectively to form two branches; and two second-slots, disposed at both sides of the main-block respectively, extending from the main-block toward the accommodating cavities respectively and then extending toward the top side of the grounding-layer;

two radiating-layers, each disposed inside each of the accommodating cavities; and two feed points, located oppositely on the first-extension side of the radiating-layers, and connecting the radiating-layers to the grounding-layer respectively.

2. A high-isolation dual-band antenna, operated in a first frequency band and a second frequency band, and comprising:

a ground zone;

two radiators, disposed at both sides of the ground zone; and an isolation zone, disposed between the radiators, wherein the isolation zone comprises: a main body; a first-slot disposed at one end of the main body; and two second-slots disposed at both sides of the main body respectively;

wherein at least a portion of the first-slot and the second-slots serves as an isolation section of the first frequency band, and at least a portion of each of the second-slots serves as an isolation section of the second frequency band, such that the isolation section of the first frequency band partially overlaps the isolation section of the second frequency band.

3. The high-isolation dual-band antenna of claim 2, wherein a frequency of the second frequency band is higher than a frequency of the first frequency band.

4. The high-isolation dual-band antenna of claim 2, further comprising two feed points connecting the radiators to the ground zone respectively, wherein one side of each of the feed point generates a first current and the first current flows along a path extending from one side of the feed point to the ground zone to generate a first exciting current in the ground zone, whereby a resonance between the first current and the first exciting current generates signals of the first frequency band.

5. The high-isolation dual-band antenna of claim 4, wherein the other side of each of the feed point generates a second current and the second current flows along a path extending from the other side of the feed point to the ground zone to generate a second exciting current in the ground zone, whereby a resonance between the second current and the second exciting current generates signals of the second frequency band.

6. The high-isolation dual-band antenna of claim 2, wherein each of the both sides of the ground zone comprises a first extension and a second extension, and an accommodating zone is formed between the first extension, the second extension and the grounding zone, wherein the radiators are disposed inside the accommodating zones respectively.

7. The high-isolation dual-band antenna of claim 6, wherein a length of the first extension is related to at least a central frequency point of the first frequency band, and a width of the first extension is related to at least a matching characteristic of the first frequency band.

8. The high-isolation dual-band antenna of claim 6, wherein a length of the second extension is related to at least a central frequency point of the second frequency band, and a width of the second extension is related to at least a matching characteristic of the second frequency band.

9. The high-isolation dual-band antenna of claim 2, wherein a length of the isolation section of the first frequency band is related to at least one of a central frequency point of an isolation of the first frequency band and the isolation of the first frequency band.

10. The high-isolation dual-band antenna of claim 2, wherein a length of the isolation section of the second frequency band is related to at least one of a central frequency point of an isolation of the second frequency band and the isolation of the second frequency band.

11. The high-isolation dual-band antenna of claim 2, wherein the first-slot extends from the main body and toward a bottom of the ground zone first, and then extends toward the radiators respectively, wherein the second-slots extend from the main body and toward the radiators respectively first and then extend toward a top of the main body.

* * * * *